US006948872B2

(12) United States Patent
Eisele

(10) Patent No.: US 6,948,872 B2
(45) Date of Patent: Sep. 27, 2005

(54) WRITING INSTRUMENT HAVING METAL CASTING AND PROCESS FOR THE MANUFACTURE THEREOF

(75) Inventor: Alfred O. Eisele, N. Front St., Parson Thorne Apt. 404, Milford, DE (US) 19963

(73) Assignee: Alfred O. Eisele, Milford, DE (US)

( * ) Notice: Subject to any disclaimer, the term of this patent is extended or adjusted under 35 U.S.C. 154(b) by 44 days.

(21) Appl. No.: 10/764,355

(22) Filed: Jan. 23, 2004

(65) Prior Publication Data

US 2005/0163556 A1 Jul. 28, 2005

(51) Int. Cl.[7] ..... B43K 25/00; B43K 29/00

(52) U.S. Cl. ..... 401/52; 401/195

(58) Field of Search ..... 401/6, 131, 52, 401/195; 24/11 R, 11 FE

(56) References Cited

U.S. PATENT DOCUMENTS

| | | | | |
|---|---|---|---|---|
| 587,243 | A * | 7/1897 | Slaon | 132/75.6 |
| 1,262,788 | A | 4/1918 | Heidenreich | |
| 1,387,625 | A | 8/1921 | Stein | |
| 1,974,667 | A * | 9/1934 | Solinger | 401/52 |
| 4,597,146 | A | 7/1986 | Larin | |
| 5,040,590 | A | 8/1991 | Brandriff | |
| 6,254,293 | B1 * | 7/2001 | Citrenbaum | 401/6 |
| 6,299,373 | B1 | 10/2001 | Cheng | |
| 6,332,727 | B1 | 12/2001 | Hsu | |

* cited by examiner

*Primary Examiner*—David J. Walczak

(57) ABSTRACT

A hand-held writing instrument is provided having a tubular barrel housing a writing mechanism and a writing tip, the barrel having externally affixed thereto, and extending circumferentially therearound, a three-dimensional metal casting. Pens, pencils and matched pen and pencil sets are provided. The writing instrument barrel is preferably made of wood or plastic, and the metal casting is preferably pewter. Also provided is a process for making the writing instruments of the invention.

17 Claims, 3 Drawing Sheets

WRITING INSTRUMENT HAVING METAL CASTING AND PROCESS FOR THE MANUFACTURE THEREOF

BACKGROUND OF THE INVENTION

The invention relates to writing instruments, specifically pens and pencils having unique and distinctive characteristics, features and feel. In particular, the invention provides such writing instruments having very highly detailed, preferably pewter metal castings thereon, and a process for the manufacture of same.

Writing instruments have existed at least from prehistoric times, viz. the crude symbols and pictures found on the walls of ancient caves. Over the years, writing instruments have been perfected and evolved to the present day, wherein pens and pencils are available in a wide variety of shapes and sizes, and range in cost from a few cents to hundreds of dollars. Individualized pens and pencils today are the products of a large and worldwide market. Pens and pencils which are embellished with the owner's initials engraved in gold or silver form prized keepsakes indeed, and become possessions which last a lifetime in some instances.

Ball point pens can be found in both the retractable type, in which the writing tip extends from and retracts into a barrel, for example by pressing on a push button at the distal end of the barrel or by rotating one portion of the barrel relative to another portion. Such pens are also available of the fixed type, some having removable caps, in which the writing tip at the proximal end of the barrel is permanently affixed to the barrel. Generally the retractable types are more costly to manufacture and, as a result, are more expensive than the fixed type. The retractable types are preferred for their ease of transport in a pocket or purse, because the writing tip can be retracted and will thus not mar or stain a shirt pocket or purse or objects therein.

For convenience and clarity of description, the present discussion and specification will focus upon the retractable type of ball point pen. However, the principles described, and the claims appended hereto, are all-encompassing and apply to fixed tip pens, of the ball point and/or the liquid ink variety, as well as to mechanical pencils. A matched set of pen and pencil using the principles of the present invention is particularly contemplated.

Pens which have various forms of ornamentation thereon are known, for example, in U.S. Pat. No. 6,299,373 B1, which discloses a ring assembly for a pen wherein adhesion of a decorative sticker on the barrel of the pen is reinforced. U.S. Pat. No. 1,387,625 discloses interchangeable display exhibits, such as pictures or inscriptions, which are attachable to pencils or pen holders. U.S. Pat. No. 1,262,788 discloses advertising displays on split sleeve-like attachments which slide over the barrel of a pencil or pen. A more recent reference, U.S. Pat. No. 6,332,727 B1, discloses a whimsical ball point pen having ornamentation wherein an ornament body produces diverse shapes. Multiple direction changes cause the ornament to make amusing twisting dances with the rotation of the pen barrel.

Unlike the prior pens and pencils disclosed in these references, the present invention relates to ornamentations on writing instruments, both pens and pencils, which are of intricately designed pewter metal and which are cast thereon by a centrifugal casting technique. Centrifugal, or spin, casting has been employed in the past to make costume jewelry, ornamental items, and metal castings, and wax investment casting patterns for precision engineered products. Such casting methods offer economic advantages in low volume production and employ relatively low cost tooling.

Centrifugal casting generally involves use of a pair of complementary disk-shaped rubber mold halves which are formed with a series of cavities therein. When the complementary rubber mold halves are placed together, a multi-cavity mold is formed. This multi-cavity rubber mold is clamped together by air pressure between rotatable metal plates in a motor driven table. As the mold spins on the table, molten metal is poured into the center sprue of the mold, and the metal is forced outwardly through radial passageways in the mold by the centrifugal forces imposed by the spinning, and fills the mold cavities. Rotation speeds typically can range from 100 to 1000 RPM, depending on the size of the mold and the material being cast. When the mold charge is completed, the rotation may be stopped, the mold cooled and opened, and the cast parts removed.

By this technique, emblems to be cloisonned have been made, as discussed in U.S. Pat. No. 4,597,146, formed of aluminum, zinc, lead, tin or other alloys to produce pewter, electrotype lead, white metal or other alloy having a low melting temperature. U.S. Pat. No. 5,040,590 discloses apparatus said to be useful in cooling the molds employed in centrifugal casting of metals used in the production of costume jewelry.

Nowhere in the known art is a teaching or suggestion of highly detailed, pewter metal ornamentations cast on and affixed to writing instruments by a centrifugal casting technique. The production of such unique writing instruments is an objective of this invention.

SUMMARY OF THE INVENTION

A writing instrument is provided having a tubular barrel housing a writing mechanism and a writing tip, wherein the barrel has a three-dimensional metal casting extending circumferentially therearound. The invention includes pens, pencils, and matched pen and pencil sets. The writing instrument barrel is preferably made of wood or plastic and the metal casting preferably is pewter, but other alloys such as alloys of aluminum, zinc, tin, or combinations thereof, which have a sufficiently low melting temperature to permit centrifugal casting thereof, would be suitable. The metal casting may have a plated coating thereover of a precious metal such as gold or silver. Also provided is a centrifugal casting process for casting pewter or other metal alloy having a sufficiently low melting temperature to permit centrifugal casting thereof onto a workpiece, wherein the workpiece is coated with a heat-resistant coating material prior to casting and wherein the workpiece is preferably a wooden or plastic pen or pencil barrel. The heat-resistant coating is preferably a heat-resistant varnish which makes possible the casting of pewter onto wood and plastic for a short period of time.

DETAILED DESCRIPTION OF THE INVENTION AND PREFERRED EMBODIMENTS WITH REFERENCE TO THE DRAWINGS

A hand-held writing instrument is provided having a tubular barrel housing a writing mechanism and a writing tip, the barrel having externally affixed thereto, and extending circumferentially therearound, a three-dimensional metal casting. Pens, pencils and matched pen and pencil sets are provided. The writing instrument barrel is preferably made of wood or plastic, and the metal casting is preferably pewter. Also provided is a process for making the writing instruments of the invention.

Figure 1:
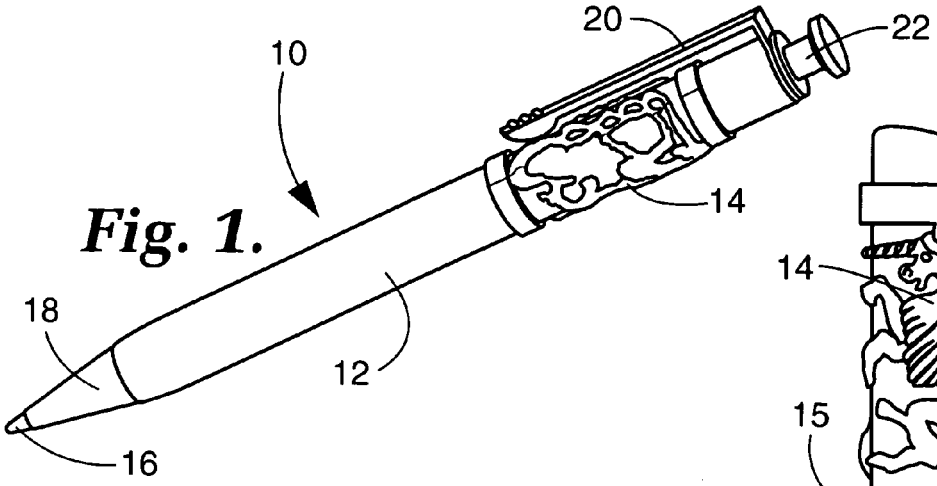
FIG. 1 is an isometric view of one embodiment of a writing instrument in accord with the present invention in the form of a retractable ball point pen.

A detailed description of the invention and preferred embodiments is best provided with reference to the accompanying drawings, wherein FIG. 1 depicts a complete retractable ball point pen 10 in one representative embodiment of a writing instrument according to the invention. The pen 10 comprises a wooden or plastic barrel 12 housing a standard ink cartridge (not seen, described below), writing tip 16 and threaded tip housing 18, and having push button 22 and conventional clip 20. Affixed to the barrel 12 and extending circumferentially therearound is the three-dimensional, metal casting 14, which is cast in place onto the housing 12 as described in detail below. While this embodiment will be described with reference to a ball point pen, it is clear that the principles of the invention apply to and extend to a variety of writing instruments including ink pens, ball pens and a variety of pencils. Matched pen and pencil sets are also included.

Figure 2:
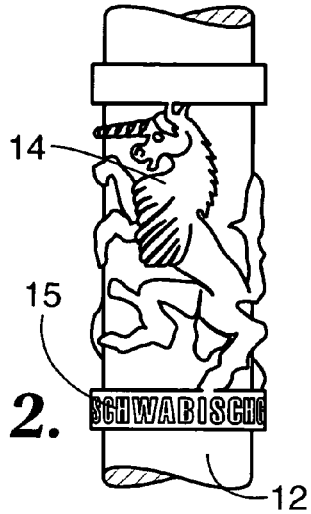
FIG. 2 is a front elevation, in perspective and partly broken away, of a pewter metal casting affixed to the barrel of a writing instrument according to the invention.

A high degree of detail is made possible in the castings according to the invention. The intricacy and degree of filigree in the castings of this invention essentially can be as detailed as the skill of the artisan who makes the master used to create the casting mold. Such castings, accordingly, can be extremely detailed. An illustration of a casting 14 depicting a unicorn and having associated indicia 15, all cast upon and affixed to a barrel 12, is shown in FIG. 2.

The invention is particularly suited to casting of relatively soft alloys such as pewter onto substrates, i.e., writing instrument barrels, such as wood or plastic which have melting/decomposition temperatures below that of the molten metal being cast. Pewter is especially suitable and, generally, alloys of aluminum, zinc, tin or combinations thereof are contemplated, wherein each alloy has a sufficiently low melt temperature to permit centrifugal casting thereof.

Figure 3:
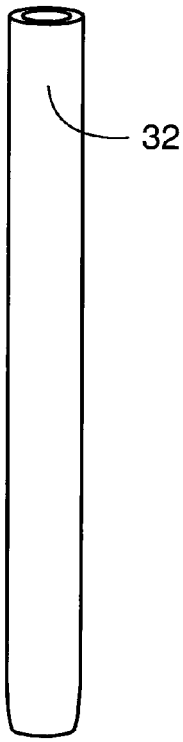
FIG. 3 depicts a tubular barrel precursor component used in the writing instrument of FIG. 1.

To prepare the ornamented writing instruments of the invention, one starts with a wooden or plastic tubular barrel 32, as shown in FIG. 3. The barrels, or shafts, may be turned on a lathe, both inside and outside, to precision tolerances.

For wooden tubular pen barrels 32, pre-treatment of the wood is desirable to impart heat resistance and hardening to the wood, to control inherent moisture in the wood, and to prevent shrinkage on casting. This pretreatment is effected by applying a heat resistant varnish or lacquer as a coating to the wooden barrels, and a lacquer supplied by the Heilemann Company, GmbH, Baenglesaelker 21, D-73527, Schwaebisch, Germany, has been found to be especially suited for this application. The preferred lacquer is Heilemann's product designation 660-Q0237-00, which is a composition generally comprising about 1–2.5% ethylbenzene, 2.5–10% xylol, 50–90% ethylacetate and 2.5–10% 2-methoxy-1-methyl-1-ethyl acetate, wherein percentages are by weight of the total compositions.

A hardening agent is also preferably applied as a precoating to the wooden shafts, and a suitable hardening agent is a varnish designated 610-001170-00, and also supplied by Heilemann.

An especially suitable precoating for wooden writing instrument barrels is a 90%/10% mixture of lacquer and hardening agent, wherein percentages are by weight.

Preferably each wooden shaft is pre-treated twice and allowed to dry for at least two days following this treatment.

For plastic instrument shafts 32, pretreatment using a heat resistant lacquer is generally sufficient, and the hardening agent is not needed. A suitable lacquer for this treatment is a heat resistant lacquer, a preferred composition of which is the product designated #665-Q0429-01 produced by the Heilemann Company aforesaid. For plastic shafts 32, only one treatment is usually required, with a drying time of about two hours being adequate. Suitable plastics for use as writing instrument barrels will include polycarbonates, nylon, DELRIN®, ABS, polyethylene and others known to those skilled in this art.

Figure 4:
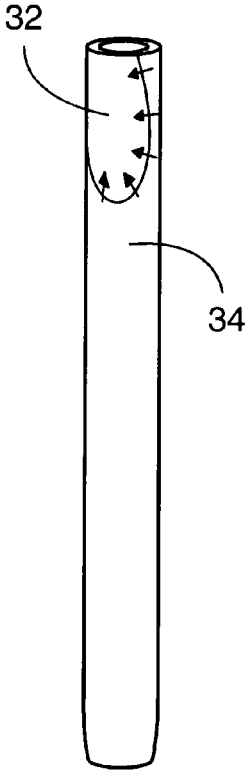
FIG. 4 shows a coating being applied to the precursor barrel of FIG. 3.

Pretreatment of the shafts/barrels is accomplished by either dipping or brushing and is depicted schematically in FIG. 4. Therein the hollow barrel 32 is depicted as being coated with the pretreatment composition 34 described above, wherein the arrows are intended to schematically represent the application of the lacquer 34 upon the barrel 32.

Figure 5:
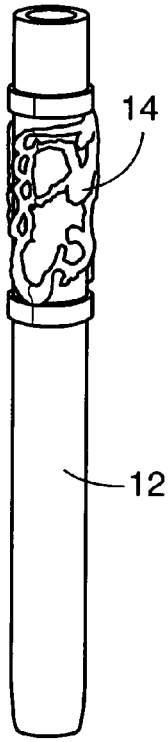
FIG. 5 depicts a three-dimensional, pewter metal casting affixed to and extending circumferentially about the tubular barrel of FIG. 4.
Figure 6:
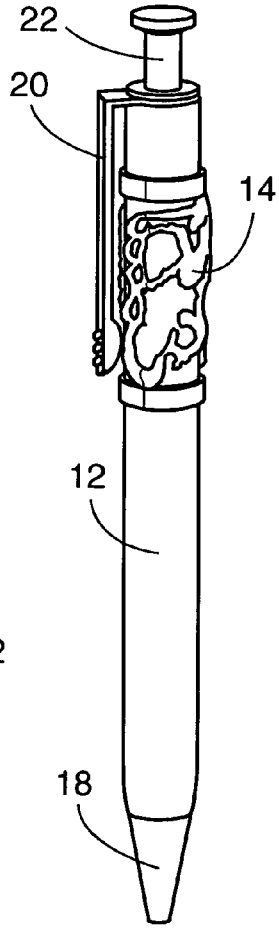
FIG. 6 completes the sequence and depicts the completed writing instrument of the invention.

FIG. 5 shows the wooden or plastic pen or pencil barrel 12 after extraction from the casting molds, all described in more detail below, and wherein the metal casting 14 is affixed thereto and extends circumferentially around the barrel 12. The writing instrument assembly is completed as shown in FIG. 6, for example, with the insertion of retractable ball point pen mechanisms into barrel 12, including cartridge housing 18, pen clip 20 and push button or plunger 22.

The process for making the adorned pens and pencils according to the invention is illustrated schematically in FIGS. 7–11. Casting processes have been used for some time to produce costume jewelry and other ornamental items and offer advantages of both economical prototype and low volume production, and relatively low cost tooling, to provide precision parts having close tolerances and smooth surfaces, as well as providing intricate detail at a low cost-per-piece.

Surprisingly, and according to the principles of the invention, molten metal castings can be affixed onto wooden or plastic workpieces such as pen barrels, with little or no adverse effect on the barrel substrate. This results in spite of the fact that the melting or decomposition temperature of the wood or plastic substrate is well below the temperature of the molten metal being cast thereon. Such a process is not disclosed or suggested in the known prior art.

Heretofore, centrifugal casting has involved the use of a pair of complementary disk-shaped rubber mold halves having a plurality of molded cavities therein. When the complementary rubber mold halves are placed together, a multi-cavity mold is formed. The multi-cavity rubber mold is clamped together under pressure between metal plates in a motor driven table. As the mold spins on the table, molten metal is poured into the center sprue of the mold, and the metal is forced outwardly by centrifugal force through radial passageways to fill the mold. Rotational speeds typically can range from 100 to 1000 RPM, depending on the size of the mold and the material being cast. The rotation is then stopped, the mold is cooled, opened, and the cast parts therein removed.

Figure 7:
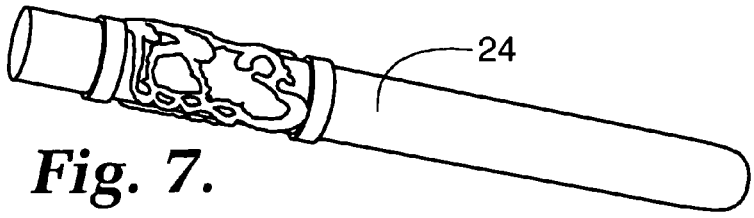
FIG. 7 is an isometric view of the master model of the decorative emblem and instrument shaft to be used to make the master mold used in the process of the invention.

In the process of the invention, a mold is first prepared by fashioning a mold-forming master, preferably out of brass, that will withstand the vulcanization process, which can be carried out at 400° F. and 600 p.s.i. The mold-forming master here, 24, preferably brass, is shown in FIG. 7. The master 24 is in the shape of a pen shaft plus the desired shape of the final casting, all as shown in FIG. 7. The intricate details of this master 24 are limited only by the skill of the artisan who creates it, either by sculpting or molding.

Figure 8:
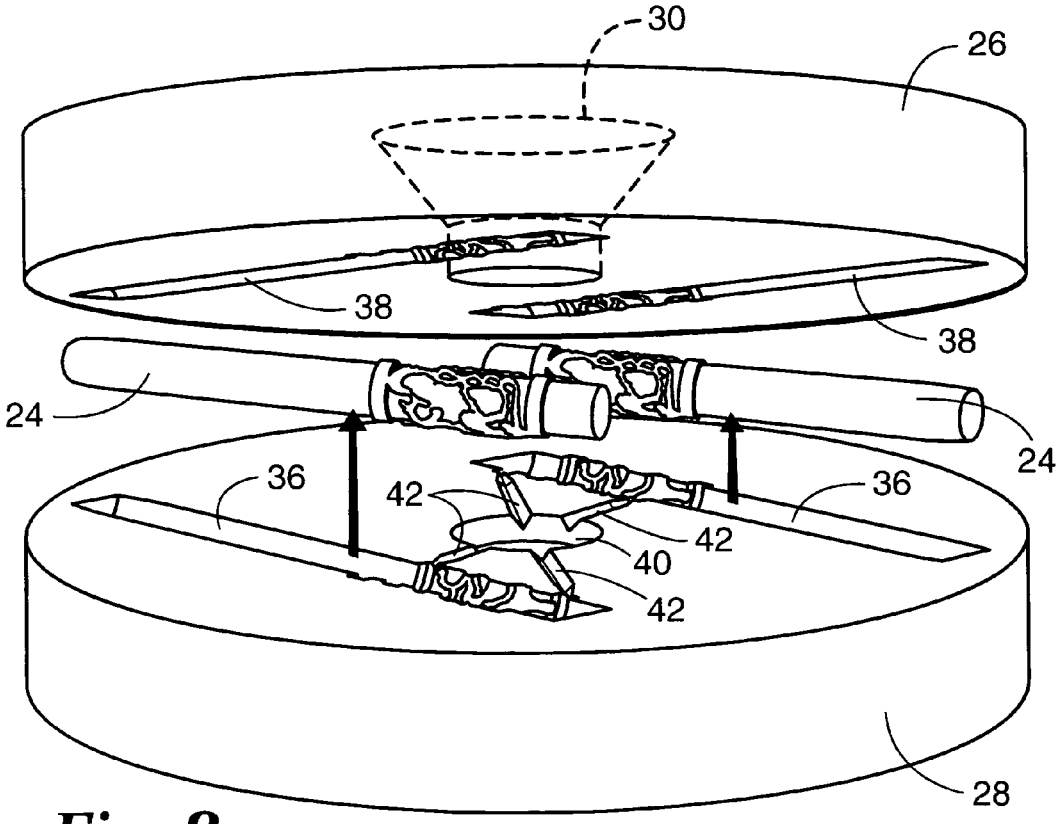
FIG. 8 depicts the making of the rubber molds used to produce the writing instruments of the invention.

In the mold-forming process, shown in FIG. 8, silicone rubber, typically in disks 26, 28 of 9–12 inch diameters, and 0.5 inch thickness, are molded by placing between them the brass masters 24, talc is applied to act as a release agent, the discs are clamped together sandwiching the masters 24 therebetween, and the rubber premolds are vulcanized. The vulcanization process takes about 1.5 hours typically, after which the molds are cooled and opened and, as shown in FIG. 8, the masters 24 can be removed, indicated by the bold arrows, thus forming the complementary mold disks 26 and 28 and the multiple half cavities 36, 38, now having the shape of the desired pen shaft and casting.

A mold having a pair of cavities is shown in FIG. 8. Additional cavities can be employed and consideration must be given to balance of the multiple cavity molds in the centrifugal casting process. Skill is required. Also shown for completeness in FIG. 8 are the inlet or sprue 30, gates 42 and basin 40, whose forming members are omitted for clarity herein.

Figure 9:
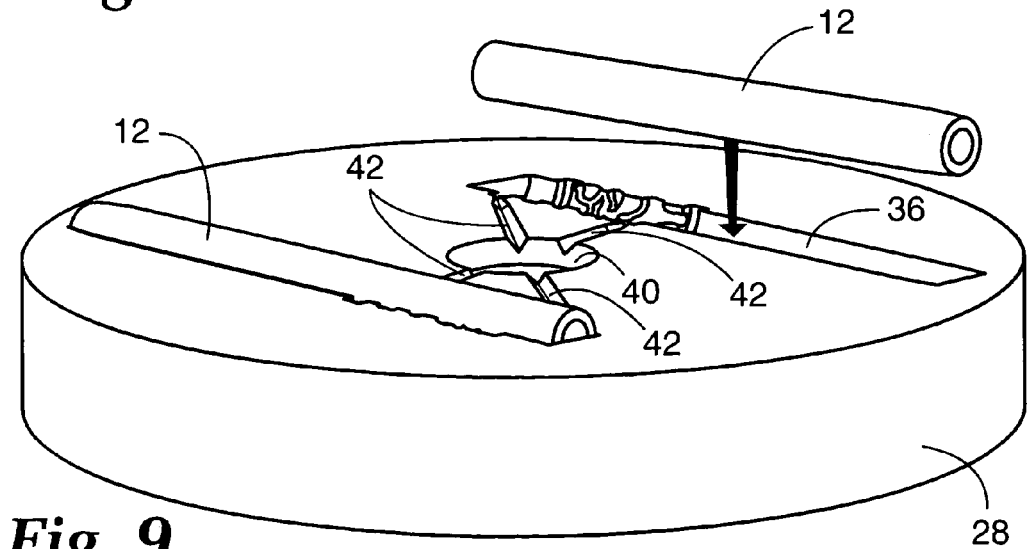
FIG. 9 shows the beginning of the casting process, wherein tubular writing instrument barrels are placed into the mold cavities prior to casting.

Once the rubber mold having the desired mold cavities is prepared, casting of the product of the invention begins. The prepared mold disks 26, 28 are placed in the centrifugal spinning machine (not shown) and, as shown in FIG. 9, a prepared wooden or plastic tubular barrel 12 is placed in each mold half-cavity 36. Each barrel 12 has been pretreated as described hereinabove with its respective heat-resistant and/or hardening lacquer. The centrifugal spinning machine is started, after clamping the complementary molds 26, 28 together, and the desired hot molten metal is poured into sprue 30 and into the mold to fill all cavities 36, 38. Once the cavities are filled, the spinning is stopped, the mold is cooled and removed from the machine, the half-molds 26, 28 are opened, and the product of the invention, duplicates shown here, are removed from the mold, as indicated by the bold arrows shown in FIG. 10.

In general, tolerances are critical in the casting operation because wood and plastic have different shrink factors than molten metal. Some trial and error may be required. Clamping pressures during casting are high, and the tubular barrels, especially where walls are thin, may require internal support to prevent collapse. A simple dowel may suffice.

In a preferred casting process, the clamping pressure is approximately 600 p.s.i., the casting alloy is a pewter tin alloy, designated OR-8xlb, HTC8001.29.0050, Contenti item 176-892, available from the Contenti Company, 123 Steward Street, Providence, R.I., 02903. The temperature of metal at cast is between 650 to 900° F., and the spinning is at 300–500 RPM. The mold temperature is preferably about 150° F., but this is regulated to an extent by the cycle time and metal temperature at casting. Thin parts may require high heat, and the right balance for a given casting may also require some trial and error.

Figure 10:
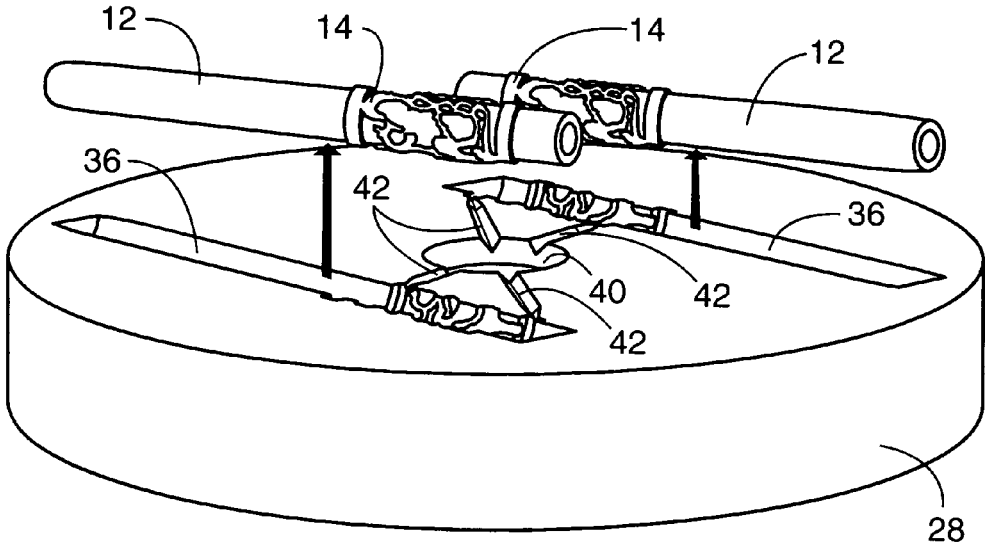
FIG. 10 shows removal of the instrument barrels after the three-dimensional pewter metal castings have been cast thereon and affixed thereto.
Figure 11:
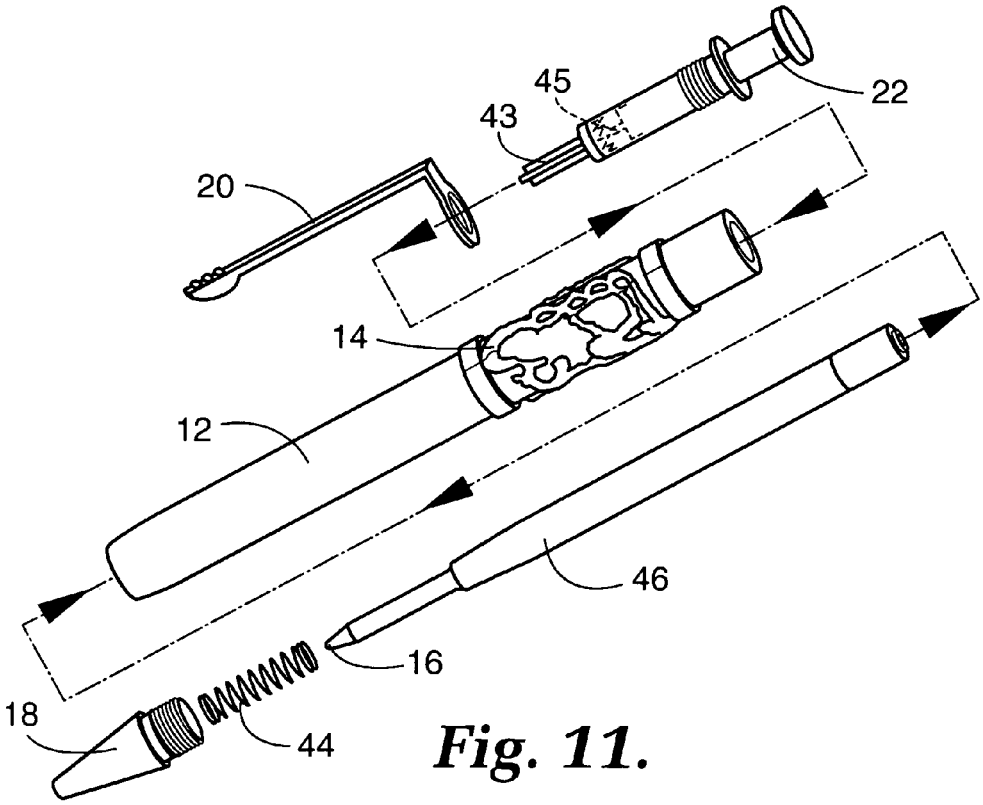
FIG. 11 depicts the final assembly of a writing instrument of the invention.

The barrels 12 having castings 14 thereon as shown in FIG. 10 may subsequently be plated with precious metals such as gold or silver. This plating may be accomplished by known techniques. Final assembly into a complete writing instrument 10 is depicted in FIG. 11. Therein the coated barrel 12 having the casting 14 affixed thereto is shown receiving at its proximal end the clip 20, ratchet 43 and advance mechanism 45, activated by push button 22, and being inserted into its distal end is the ink barrel 46 having writing tip 16, extending through spring 44 and housing 18 which threadably engages the barrel (not shown) to anchor all components in place, thereby completing assembly of a writing instrument 10, shown in FIG. 1, all according to the invention herein.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A hand-held writing instrument comprising a tubular barrel housing a writing mechanism and a writing tip, said barrel having externally affixed thereto a three-dimensional metal casting extending circumferentially around said barrel and secured to said barrel during a casting process and a heat resistant varnish or lacquer coating on said barrel capable of preventing shrinkage of said barrel during the casting process.

2. The instrument of claim 1 being a pen.

3. The instrument of claim 1 being a pencil.

4. The writing instrument of claim 1 having a retractable writing mechanism and writing tip.

5. The writing instrument of claim 1 having a fixed writing mechanism and writing tip.

6. The writing instrument of claim 1 wherein said barrel is made of wood.

7. The writing instrument of claim 1 wherein said barrel is made of plastic.

8. The writing instrument of claim 7 wherein said plastic is selected from the class comprising polycarbonates, nylon, DELRIN®, ABS and polyethylene.

9. The writing instrument of claim 1 wherein said metal is pewter.

10. The writing instrument of claim 1 wherein said metal is an alloy of aluminum, zinc, tin, or combination thereof, which has a sufficiently low melting temperature to permit centrifugal casting thereof.

11. The writing instrument of claim 1 wherein said metal casting has a plated coating thereover of a precious metal.

12. The writing instrument of claim 11 wherein said precious metal is gold.

13. The writing instrument of claim 11 wherein said precious metal is silver.

14. The writing instrument of claim 1 being a pen having a retractable writing mechanism and tip wherein said barrel is made of wood and said metal casting is pewter.

15. The writing instrument of claim 1 being a pencil having a retractable writing mechanism and tip wherein said barrel is made of wood and said metal casting is pewter.

16. The writing instrument of claim 1 being a pen having a retractable writing mechanism and tip wherein said barrel is made of plastic and said metal casting is pewter.

17. The writing instrument of claim 1 being a pencil having a retractable writing mechanism and tip wherein said barrel is made of plastic and said metal casting is pewter.

* * * * *